United States Patent [19]

Edson

[11] 4,073,418

[45] Feb. 14, 1978

[54] HOLDER FOR ARTIST PAINT TUBES

[76] Inventor: Harold C. Edson, 1449 W. 17th, Davenport, Iowa 52804

[21] Appl. No.: 772,525

[22] Filed: Feb. 28, 1977

[51] Int. Cl.[2] ..... A45C 11/00

[52] U.S. Cl. ..... 224/45 R; 53/381 A; 188/75; 188/246; 222/174; 248/108

[58] Field of Search ..... 224/45 R, 45 P; 81/111, 81/3.44, 57.17, 64; 269/287; 16/116; 53/281 A, 390; 248/74, 108, 109, 54 R; 222/174, 105, 465; 188/75, 246, 250 F

[56] References Cited

U.S. PATENT DOCUMENTS

| | | | |
|---|---|---|---|
| 699,803 | 5/1902 | Monehan et al. | 81/3.44 |
| 913,336 | 2/1909 | Westerbeck | 81/3.44 |
| 1,069,937 | 8/1913 | Goehst et al. | 248/74 R X |
| 2,954,063 | 9/1960 | Wilbur | 81/3.44 X |
| 3,036,667 | 5/1962 | Schilling | 188/75 |
| 3,389,622 | 6/1968 | Flugel | 81/3.44 |
| 3,590,668 | 7/1971 | Bristol | 81/64 |

*Primary Examiner*—Drayton E. Hoffman
*Assistant Examiner*—Donald W. Underwood
*Attorney, Agent, or Firm*—Glenn H. Antrim

[57] ABSTRACT

A small holder having a pair of jaws, has the general configuration of prior larger holders to be used for opening jars, but the inside surfaces of the jaws have thick cushions to conform to the wall of artist paint tubes. The cushions have thin supporting members to be attached to jaw members and are easily removable for changing to cushions with different thicknesses for holding tubes of different diameters.

1 Claim, 4 Drawing Figures

HOLDER FOR ARTIST PAINT TUBES

BACKGROUND OF THE INVENTION

This invention relates to jaw-type holders that function as wrenches for containers, and particularly to holders with removable, cushioning gripping pads that apply a minimum amount of compressive force while restraining the tubes from rotation.

Artist paints are conventionally in tubes of thin, pliable metal that are easily deformed with moderate pressure. Caps for sealing the tubes are difficult to remove when the tubes are to be used after paint that was left on threads of their stems during previous use has had time to dry. If the tubes are gripped by a bare hand while the caps are unscrewed, the tubes are not only likely to be deformed, but they may break and waste the paints. The types of holders that have generally been available, such as those for holding Mason jars, are suitable for rigid containers, but they do not distribute pressure evenly enough for artist paint tubes and do not have provisions for gripping containers of different diameters.

SUMMARY OF THE INVENTION

The present holder resembles certain holders for Mason jars in that it has a head with a pair of hinged jaw members and handles extending from the jaw members for applying a gripping force. However, the present holder for artist paint tubes has a thick cushioning, gripping pad within each jaw member, and one or both of the gripping pads can be easily replaced with a pad having different thickness for gripping paint tubes of different diameters.

Each gripping pad is preferably semicircular and has an outer band or supporting member of thin, stiff material, such as hard rubber, that conforms to the inner surface of the respective jaw. To retain the gripping pad, the band may have at its edges circumferential flanges that fit tightly over the adjacent sides of the jaw member in which it is placed, and to prevent rotation of the gripping pad within its jaw member, at least one of its flanges may have an outwardly facing notch that functions as a keyway about a pin or key that protrudes from the side of the jaw member. A semicircular, thick band of cushioning material of moderate resiliency is secured to the inner surface of each of the stiff, semicircular supporting members. The cushioning pads have such thickness that when the handles of a holder are closed, the diameter of the central opening formed by a pair of opposite pads is less than the diameter of the artist paint tubes that are to be opened. When different sizes of paint tubes are to be opened, the gripping pads that have previously been used are readily removable, and gripping pads of different thickness in a diametrical direction are readily inserted.

DESCRIPTION OF THE PREFERRED EMBODIMENT

Figure 1:
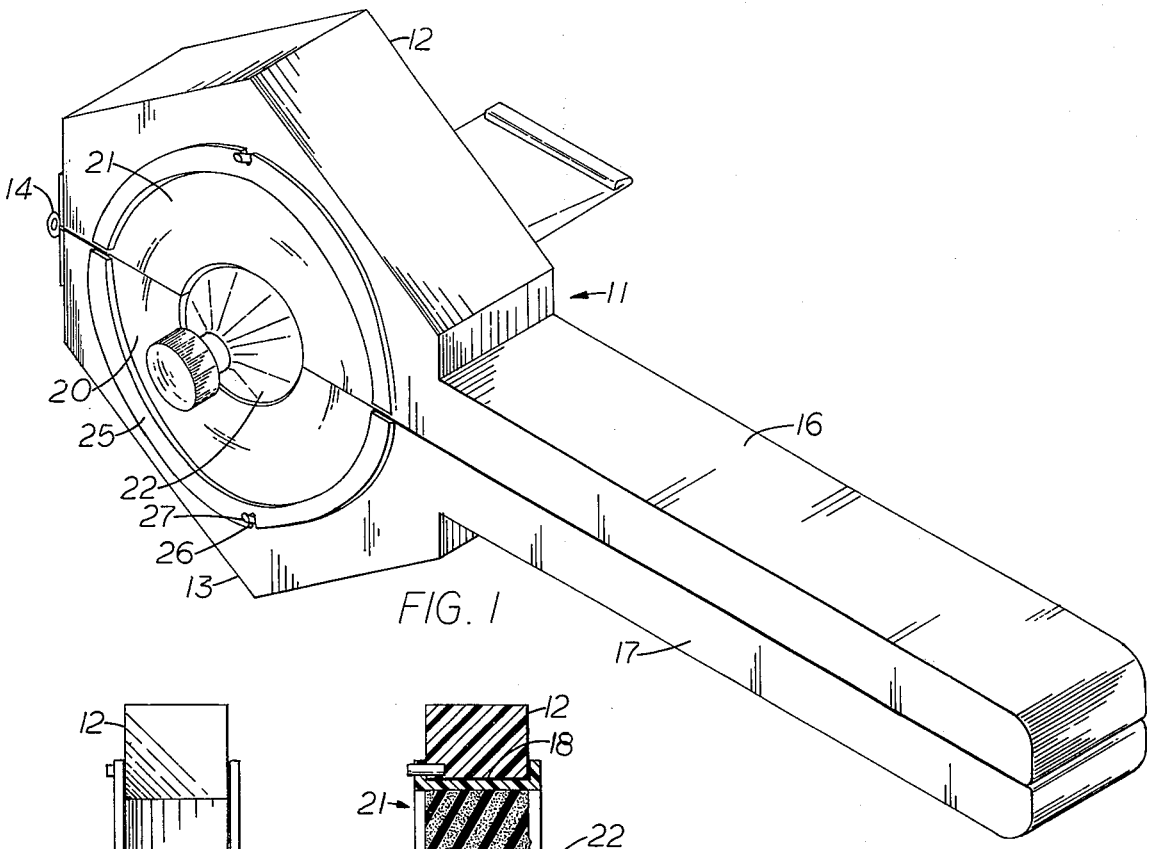
FIG. 1 is a perspective view of a holder in a closed position about an artist paint tube.
Figure 2:
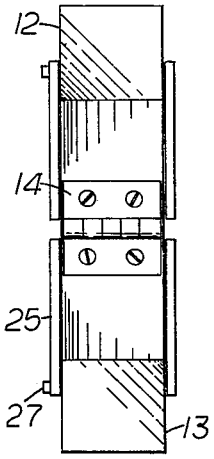
FIG. 2 is an end view showing the pivotal portion of the holder.
Figure 4:
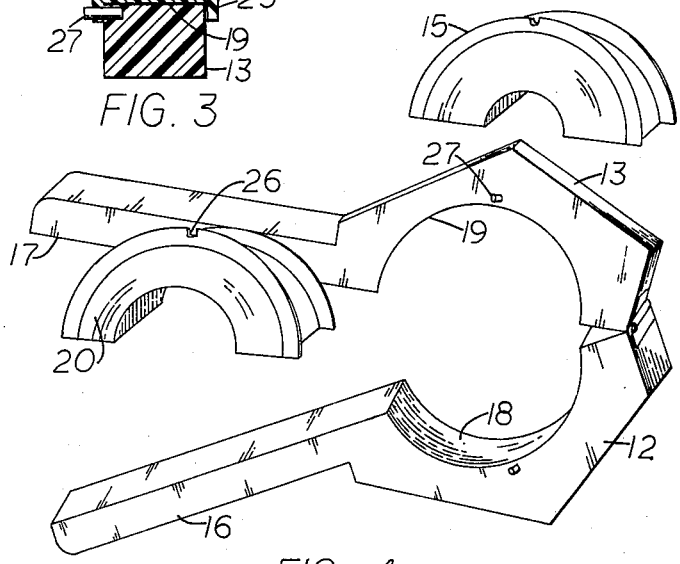
FIG. 4 is a perspective view of the jaw members of FIG. 1 in an open position and two removed gripping pads having cushions of different diametrical thickness.

The holder 11 of FIG. 1 has jaw members 12 and 13 connected together at one end by a hinge 14 (FIG. 2). A pair of handles 16 and 17 extend opposite the hinge 14 from the ends of the jaw members 12 and 13 respectively. With reference to FIG. 4, the jaw members 12 and 13 have similar opposite arcuate depressions 18 and 19 respectively. The jaw members 12 and 13 and the handles 16 and 17 are fabricated from a rigid material and preferably may be made from a plastic and joined by a piece of flexible plastic that serves as the hinge 14.

Semicircular gripping pads 20 and 21 are inserted within the arcuate depressions 18 and 19 of jaw members 12 and 13 respectively. When the handles 16 and 17 are pressed together to close the jaw members 12 and 13, the inside faces of the gripping pads 20 and 21 form a circular opening that has a diameter less than the diameter of a tube 22 that is to be held by the holder 11.

Figure 3:
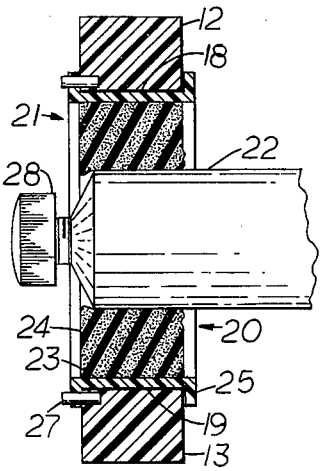
FIG. 3 is a diametrical cross section of the holder of FIG. 1 taken on a line perpendicular to the handles.

With reference to FIGS. 3 and 4, the gripping pad 20 has relatively thin supporting member 23 in the shape of a semicircular band to fit within the arcuate depression 19 of the jaw member 12, and has attached by adhesive to the inner side of the band, a thick, semicircular pad of cushioning material 24. The supporting member 23 has at each of its edges circumferential, outwardly turned flanges 25, and the width of the supporting member 23 is such that the flanges 25 overlap tightly along the adjacent sides of the jaw member 13. The supporting member 23 is fabricated from hard rubber or other stiff materials that will function sufficiently as a spring to urge the flanges 25 tightly against the adjacent sides of the jaw member 13.

With reference to FIGS. 1 and 4, a notch 26 is formed in the outer edge of at least one of the flanges 25 to receive a pin 27 protruding from one of the sides of the jaw member 13. The pin 27 functions as a key, and the slot 26 functions as a keyway to prevent rotation of the gripping pad 20 within the arcuate depression 19 of the jaw member 13. The gripping pad 21 for the opposite jaw member 12 is usually interchangeable with the gripping pad 20, but the cushioning material of the gripping pad 21 may be secured directly to the arcuate depression 18 of the jaw member 12, and then only a single gripping pad 20 need be changed for holding tubes of different diameters. The cushioning material 24 of the gripping pads 20 and 21 is rubber or plastic foam that is firmer than the foam cushioning materials used for chair cushions.

With reference to FIG. 4, the cushioning material of a gripping pad 15 is thicker in a diametrical direction than the cushioning material of the gripping pad 20. When the holder 11 is to be used for tubes of smaller diameter, the gripping pad 20 is removed from the jaw member 13, and the gripping pad 15 is substituted within the arcuate depression 19. Likewise, another gripping pad similar to the pad 15 is inserted in the arcuate depression 18 of the jaw member 12.

With reference to FIGS. 1 and 3, the gripping pads 20 and 21 having a desired thickness of cushioning material 24 are selected such that the cushioning material 24 is compressed somewhat when the handles 16 and 17 are brought together to hold a tube 22. The tube 22 is positioned such that its end next to the cap is a short distance inside the opening between the gripping pads 20 and 21. When the tube 22 is the proper diameter for the thickness of the cushioning material 24, the cushioning material 24 is compressed somewhat and the tube 22 is held securely enough to prevent its rotation. The cushioning material 24 spreads the inwardly force applied by the holder 11 quite evenly about the end of the tube 22 to prevent its deformation and possible rupture. While the holder 11 is held with one hand, the cap 28 is turned to remove it from the tube.

I claim:

1. A holder comprising a pair of hinged rigid jaw members, said jaw members having deeply depressed central portions, a pair of handles connected to said jaw members, a gripping pad of cushioning material positioned within each of said deeply depressed central portions of said jaw members for holding tubes containing a paste, said gripping pads while said jaw members are closed providing a central opening therebetween, said central opening having a substantially smaller cross section than that of a tube that is to be held between said gripping pads, each of said gripping pads having substantial thickness between the boundary of said opening and said respective jaw members, at least one of said gripping pads being removably secured to said respective jaw member to facilitate changing pads with cushions of different thickness, said removable gripping pad having an inner thin stiff supporting member conforming to said deeply depressed central portion of said respective jaw member and having on each side thereof a flange extending circumferentially outwardly over the adjacent side of said respective jaw member, said inner stiff supporting member having sufficient elasticity to urge said flanges inwardly tightly against the sides of said respective jaw member to secure said inner stiff supporting member, at least one of said flanges having a slot as a keyway through the rim thereof, and a pin as a key extending through said keyway from the adjacent side of said respective jaw member.

* * * * *